US006698232B1

(12) United States Patent
Duppert et al.

(10) Patent No.: US 6,698,232 B1
(45) Date of Patent: Mar. 2, 2004

(54) OIL LEAK DIVERSION AND COLLECTION SYSTEM FOR MECHANICAL SHAFT SEALS

(75) Inventors: Ronald J. Duppert, Fayetteville, NY (US); Christopher A. Wyker, Liverpool, NY (US); Kenneth A. Wright, Syracuse, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/283,939

(22) Filed: Oct. 30, 2002

(51) Int. Cl.[7] ..... F25B 43/02; F25B 43/00
(52) U.S. Cl. ..... 62/470; 62/474
(58) Field of Search ..... 62/470, 474, 508; 417/415

(56) References Cited

U.S. PATENT DOCUMENTS 4,834,627 A * 5/1989 Gannaway ..... 417/415

FOREIGN PATENT DOCUMENTS

JP 362258177 A * 11/1987 ..... 417/269

* cited by examiner

*Primary Examiner*—Melvin Jones

(57) ABSTRACT

A compressor oil diversion and collection system used in a compressor having a housing, a crankshaft having shaft seals, refrigerant and a compression device for compressing the refrigerant. The system includes a shaft sealing mechanism that uses a lubricant for preventing compressor refrigerant from leaking out of the compressor housing and has a space where the lubricant collects. A diversion mechanism is deployed for directing excess amounts of said lubricant from the space to a receiver for receiving the excess amounts of said lubricant from the diversion mechanism. The receiver may be in the form of an internal cavity which includes a removable cartridge located in the cavity for collecting the excess amounts of said lubricant, an external collection reservoir or an external drainage tube.

18 Claims, 6 Drawing Sheets

OIL LEAK DIVERSION AND COLLECTION SYSTEM FOR MECHANICAL SHAFT SEALS

BACKGROUND OF THE INVENTION

1. Field of the Invention

The present invention relates to a system for controlling oil seepage from a compressor. More particularly, the present invention concerns a system for diverting and collecting excess oil originating in the area of the shaft seal of the crankshaft of a reciprocating compressor.

2. Background Art

Refrigeration systems, such as the type used in transport refrigeration equipment, include, in the simplest form, a compressor, a condenser, an expansion device and an evaporator serially interconnected to form a closed refrigeration circulation path. Typically, such systems use a reciprocating type compressor that is lubricated by a lubricating oil which mixes with the refrigerant being compressed therein.

A typical reciprocating compressor includes a piston reciprocating within a cylinder for mechanically compressing gaseous refrigerant. Appropriate manifolds and valves are provided to allow gas to be drawn into the cylinder during the down stroke of the piston and to be compressed during the up stroke.

Oil is used in such compressors to lubricate the various parts and interfaces there between. To maintain refrigerant pressure within the compressor, mechanical shaft seals are used that deploy an oil film to seal against the leakage of pressurized gas and to lubricate the faces of the seal during operation. For example, such seals are used on the crankshaft of the compressor such as in the vicinity of the gland plate. Oil leakage across the seal faces is a common problem with any mechanical shaft seal. If such oil is allowed to leak unabated, external oil leakage through the crankcase can result. Typically such leakage is more visually unpleasing and alarming rather than detrimental to compressor function; however, such leakage often leads to unnecessary component replacement of the mechanical shaft seal components.

Accordingly, devices have been deployed to divert excess oil from the crankshaft seal area to hide external leakages. One such device is an external masking device used on an open-drive compressor known as the Bock FKX40/465. The device allows oil to leak to an external pocket, which is open to the atmosphere, on the outside of the gland plate and then utilizes an absorbent material to capture the excess oil over flowing therefrom. The absorbent material is encapsulated by a band of spring steel that is wrapped around the outside diameter of the material which is in turn wrapped around the gland plate housing in proximity to the external pocket.

While effective, these types of designs use an oil soaked external absorbent band which attracts dirt and can soil its surroundings, adding to the soiling of the external surfaces of the compressor.

SUMMARY OF THE INVENTION

It is an object of the present invention to reduce oil leakage in a device using shaft seals.

It is a further object of the present invention to provide an improved mechanism for diverting excess oil away from a shaft seal.

It is another object of the present invention to provide an improved mechanism for collecting excess oil after its diversion from a shaft seal.

It is another object of the present invention to provide a means for absorbing excess oil from the vicinity of a shaft seal.

It is still another object of the present invention to provide a means for providing external notice of excess oil absorbed from the vicinity of a mechanical shaft seal These and other objects of the present invention are achieved according with the compressor oil diversion and collection system of the present invention, for use in a compressor having a housing, a crankshaft having shaft seals, refrigerant and a compression device for compressing the refrigerant. The system includes a shaft sealing mechanism that uses a lubricant for preventing compressor refrigerant from leaking out of the compressor housing and has a space where the lubricant collects. A diversion mechanism is deployed for directing excess amounts of the lubricant from the space to a receiver for receiving the excess amounts of said lubricant from the diversion mechanism. The receiver may be in the form of an internal cavity which includes a removable cartridge located in the cavity to collect the excess amount of lubricant, an external collection reservoir or an external drainage tube.

DESCRIPTION OF THE PREFERRED EMBODIMENT

The invention as described herein will refer to a reciprocating compressor for use with an air conditioning or refrigeration system. Although this compressor is shown in a configuration and described relative to incorporation with a refrigeration circuit within an air conditioning system or a refrigeration system it is to be understood that this method of oil collection and diversion is equally applicable to other types of compressors, pumps and other applications.

Figure 1:
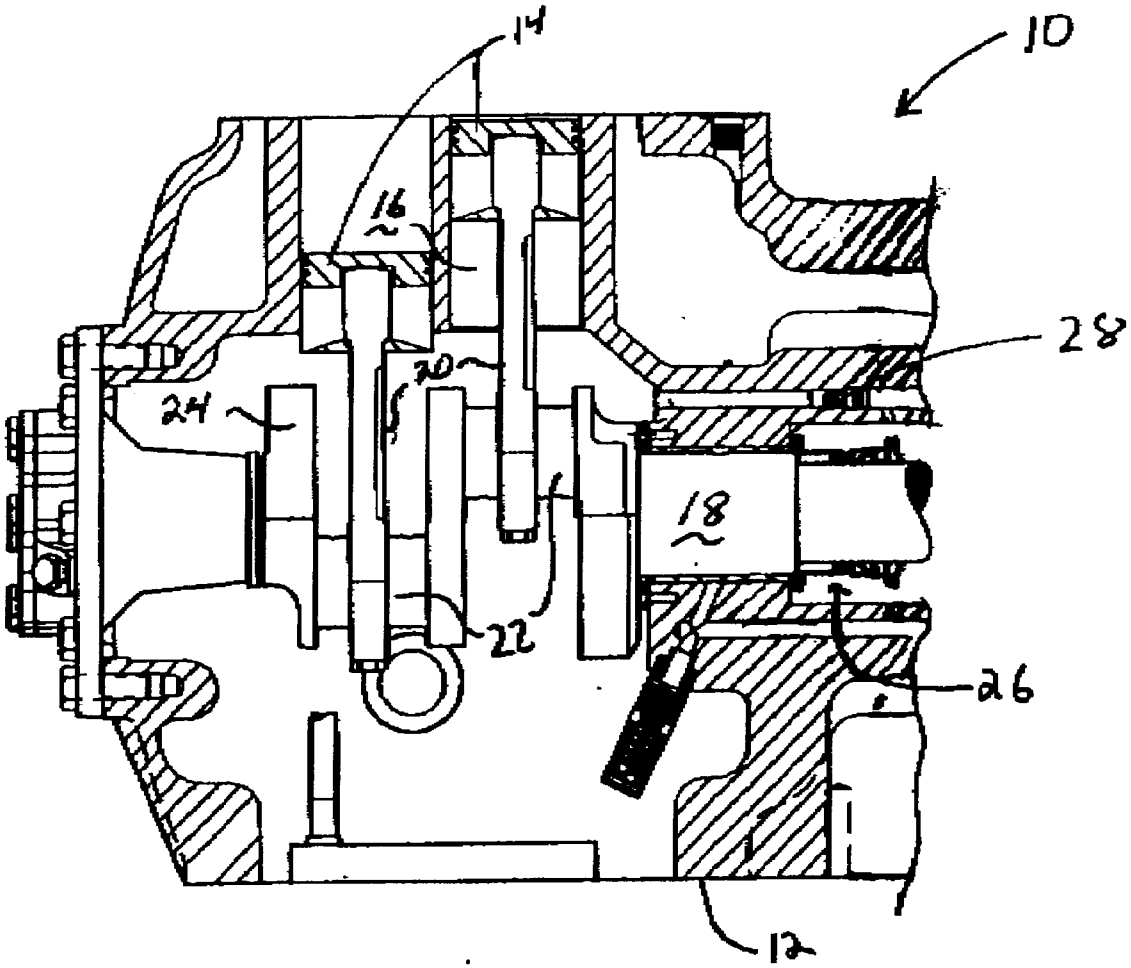
FIG. 1 is a schematic view of a reciprocating compressor incorporating the device of the present invention.

Referring now to FIG. 1, shown is a compressor 10 including shell 12. Working pistons 14 are mounted for reciprocating movement within cylinders 16. Each piston is connected to crankshaft 18 via a connecting rod 20. Connecting rod 20 is secured around offset portion 22 of crankshaft 18. Crankshaft 18 includes counterbalance 24 for balancing the rotational irregularities in the crankshaft. The crankshaft is mounted and rotates within sleeve 28 and extends through shaft seal cavity 26 of housing 12.

Figures 2, 4:
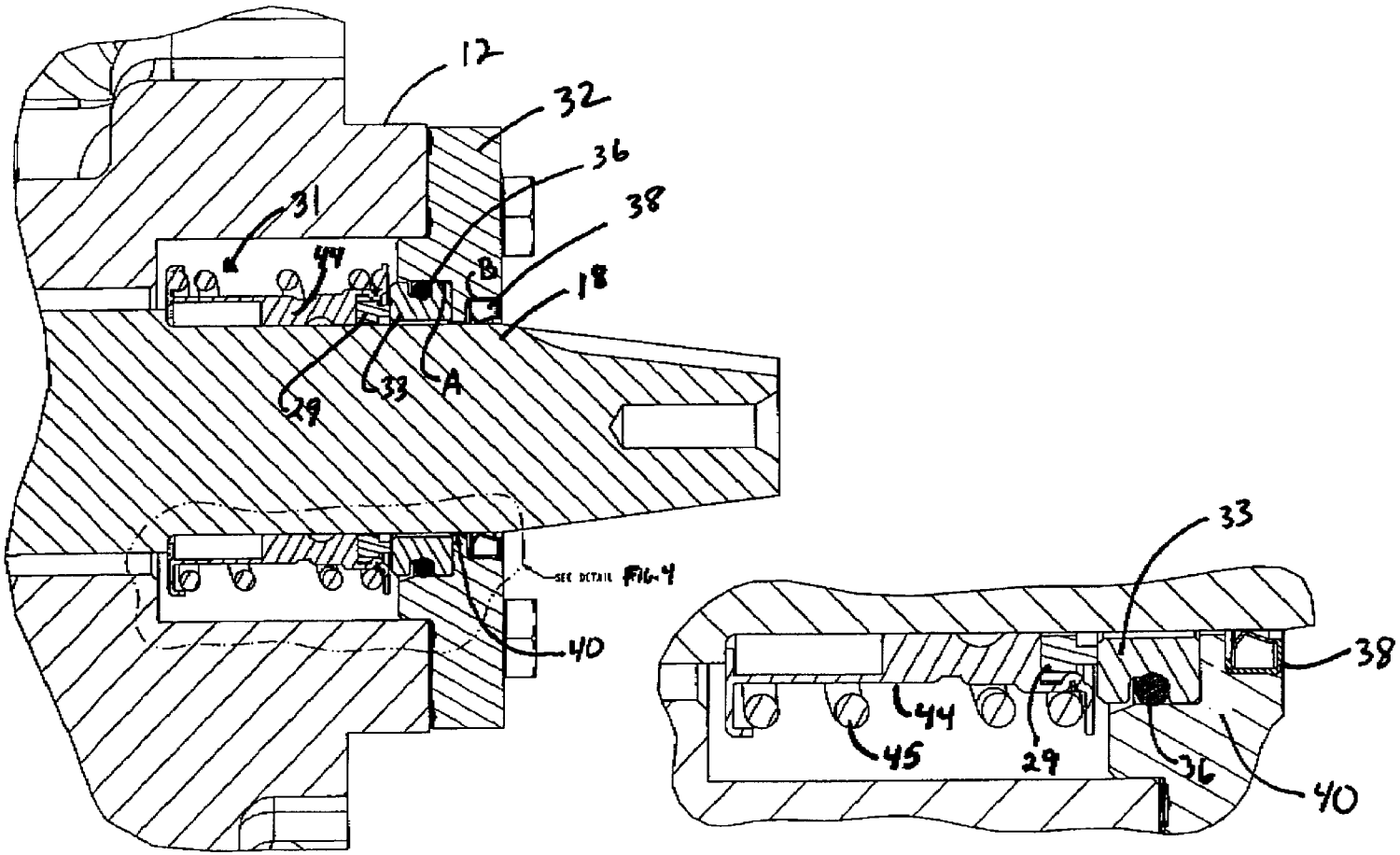
FIG. 2 is an enlarged view of the crankshaft seal area of FIG. 1.
FIG. 4 is a further blown up view of the view shown in FIG. 2.
Figure 3:
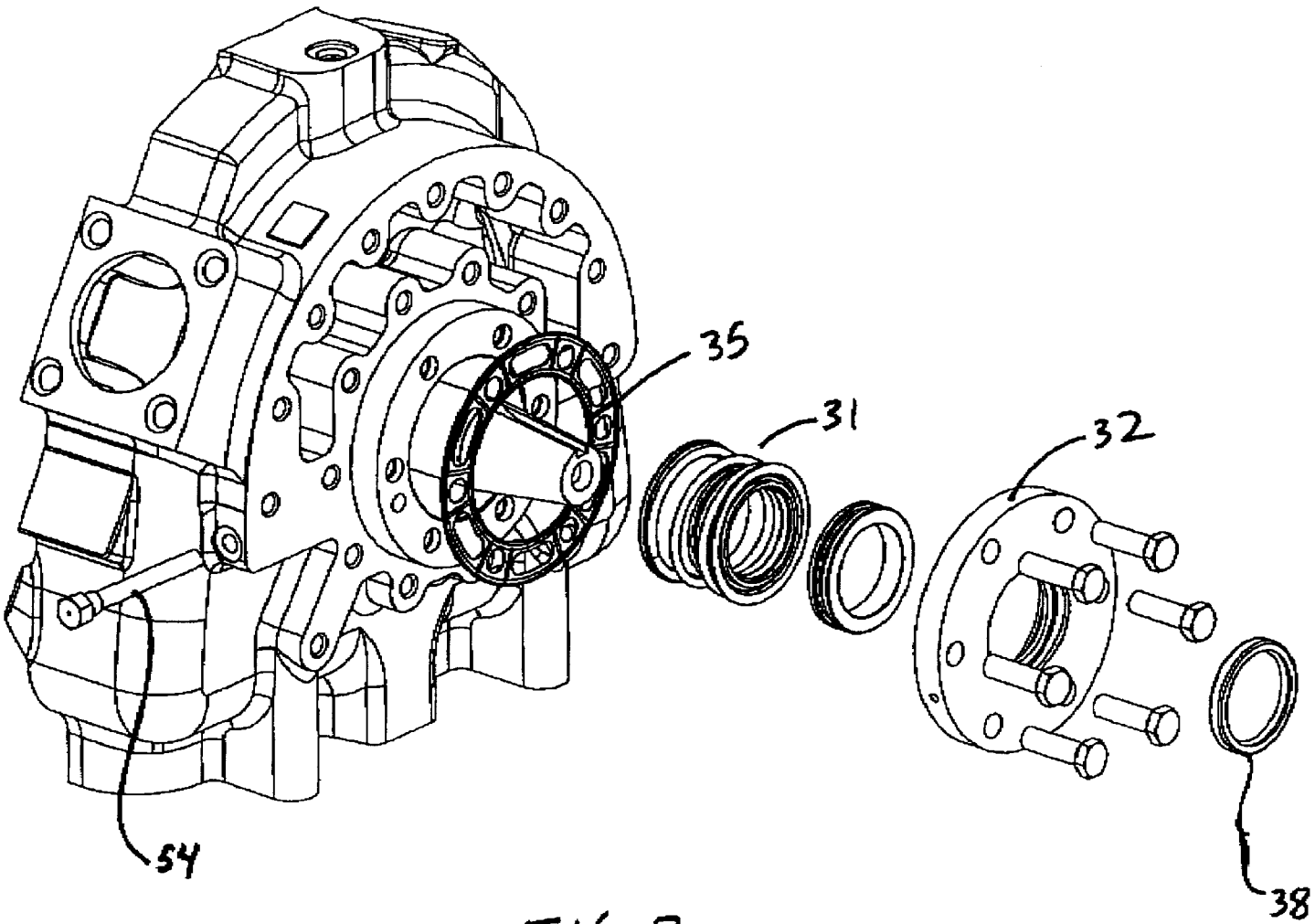
FIG. 3 is an exploded end view of the compressor shown in FIG. 1, with the absorbent cartridge shown being installed.

Referring to FIG. 2 and 4, the crankshaft seal mechanism 31 is shown in greater detail at the point where the housing 12 is exited by the crankshaft. The crankshaft 18 passes through the spring assembly 45, shaft seal faces 29 and 33, gland plate 32 and lip seal 38. The face seal 33 is substantially cylindrical in shape and includes an O-ring 36, which holds it stationary within inner diameter A of the gland plate 32. The lip seal 38, located in gland plate adjacent to diameter A, in smaller diameter B, has the function of preventing dirt from entering the shaft seal cavity. An inner disc-shaped space 40 is located between face seal 33 and lip seal 38. As shown in FIG. 3, a gland plate gasket 35 is used to prevent seepage between the housing and the gland plate.

The crankshaft seal mechanism further includes a cylindrical body 44 formed from a resilient material, using oil between it and the crankshaft to act as a refrigerant seal. A spring 45 wrapped around the exterior of the body 44 and resting against the crankshaft seal thrust face provides axial loading between the two shaft seal faces 29 and 33. The two faces are loaded such that, with the use of oil, they will act as a refrigerant seal. In the prior art, where oil passing across the two shaft seal faces is not removed or redirected, it will pass through crankshaft to the lip seal interface that is located as shown in FIG. 3, leading to leakage and soiling of the external surfaces of the compressor. This external leakage and soiling often leads to incorrect conclusions that a serious mechanical problem exists with the compressor.

Figure 5:
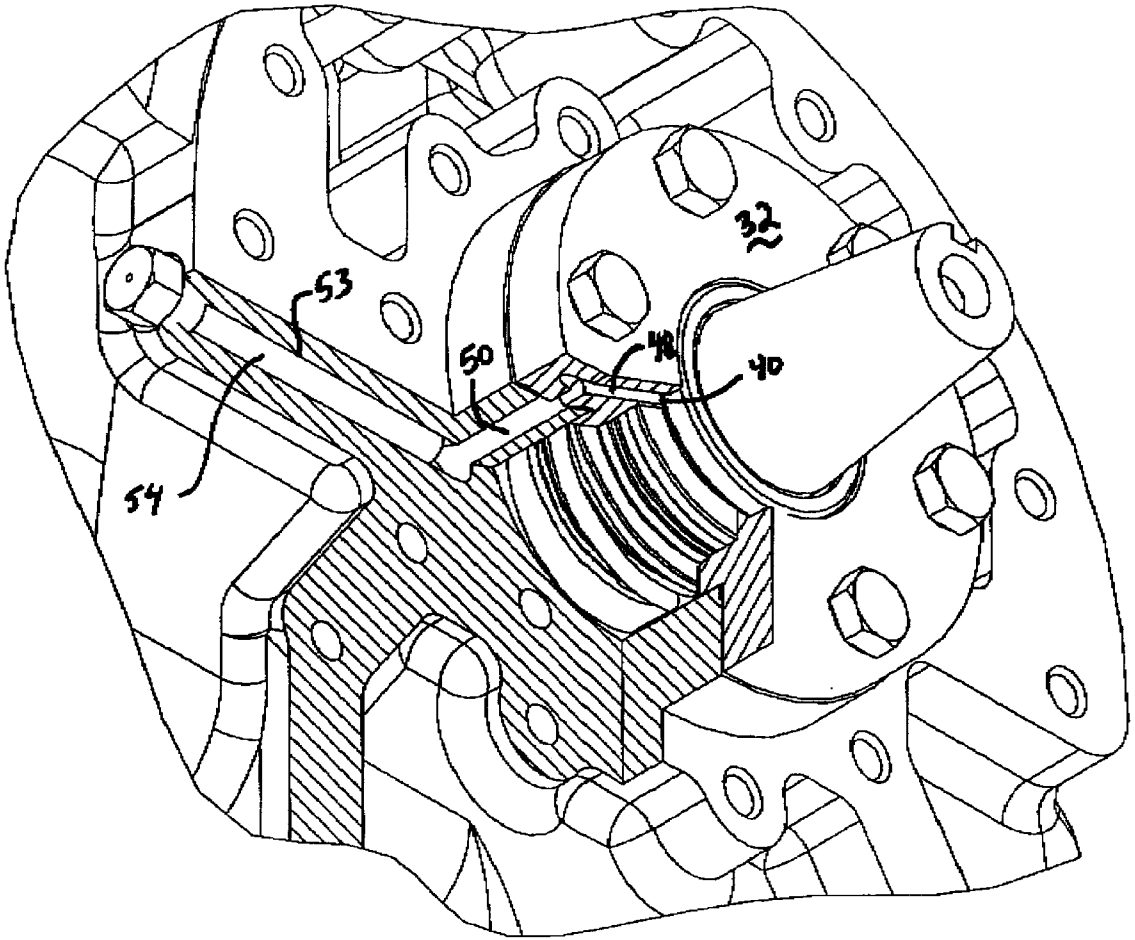
FIG. 5 is an enlarged cut-away view of FIG. 3, showing the oil flow passages.
Figure 6:
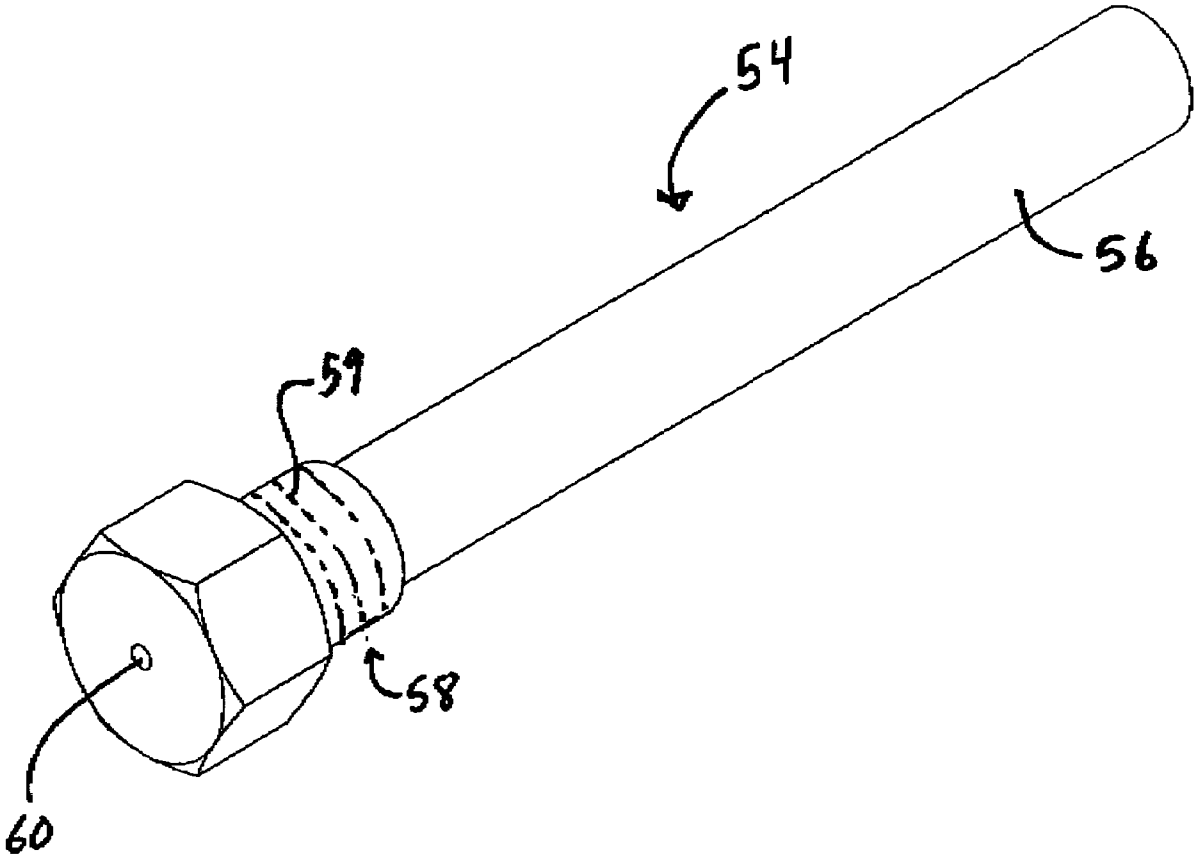
FIG. 6 is an enlarged view of the absorbent cartridge shown in FIG. 3.

The invention as provided herein operates to remove the excess oil to prevent detrimental effects thereof. Referring to FIG. 5, in accordance with the principles of the present invention, a first passage 48 is provided in gland plate 32 that leads to a second passage 50 in housing 12, which further leads to a receiver, and in the one embodiment, an internal cavity 53. Accordingly, excess oil leaves space 40 through first passage 48, within which it travels to second passage 50 in the crankcase housing. Oil then travels within second passage 50 to internal cavity 53. In the preferred embodiment, the internal cavity is elongated and accepts an elongated cartridge or insert 54, also shown in FIG. 6, having an elongated portion formed of an absorbent material for absorbing the oil within internal cavity 53. Within the scope of the invention, the cavity could have other shapes or configurations, with a complimentary shaped cartridge or insert. In the preferred embodiment, the cartridge 54, includes an elongated absorbent portion 56 and a connecting portion 58. The crankcase housing at the external end of cavity 53, in one embodiment, is threaded to engage a threaded interface 59 of connecting portion 58 of cartridge 54, securing the insert within cavity 53 for the absorption of oil. Other connection interfaces could be used as well such as a snap fit, tapered force fit or rotatably locking fit as long as such connections make an appropriate seal and secure connection, and allow the cartridge or insert to be easily removed for servicing. Threaded end 58 includes a weep hole 60. Hole 60 equalizes the pressure in the crankcase oil cavity with atmospheric pressure, allowing the oil to drain freely from the crankcase oil cavity to the internal oil cavity 53. The weep hole 60 further acts as a visual indicator as to when the cartridge 54 is full of oil, and replacement is needed, as oil will begin to weep from the hole when saturation is reached. Upon saturation, the cartridge can be removed in the field and replaced with a new cartridge, easing serviceability of the compressor. An alternative design to the absorbent cartridge described above is a cartridge or insert configured as described but with an integral well, as opposed to an absorbent material,- for collecting the excess lubricant, which could be removed and emptied.

Figure 7:
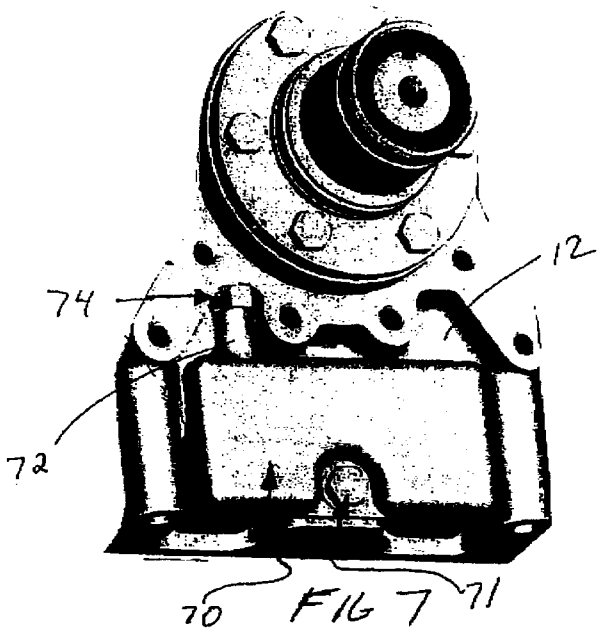
FIG. 7 is an end view of the compressor shown in FIG. 1, showing an external reservoir as an alternative embodiment of the present invention.
Figure 8:
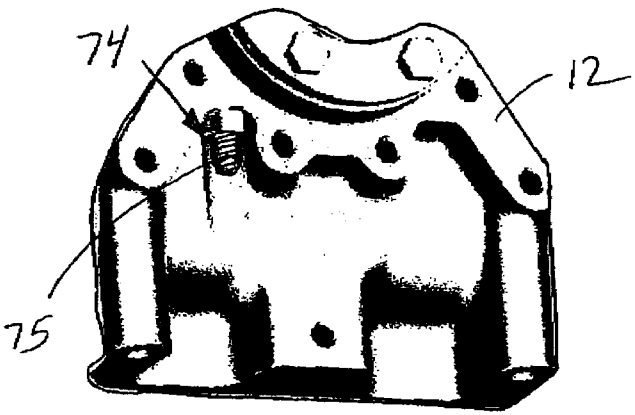
FIG. 8, is the same view as FIG. 7 without the external reservoir attached.

In another embodiment, an external collection reservoir, as shown in FIG. 7, is used as the receiver. Accordingly, reservoir 70 is mounted to the compressor housing 12 via a bolt 71 and includes an inlet 72 mounted to an outlet 74, shown in FIG. 8, on housing 12. Inlet 72 receives oil from outlet 74 which receives oil from passage 50, which is diverted similar to as described above from space 40 (See FIG. 5), but for this embodiment, to the outlet 74. Outlet 74 is preferably threaded 75 but inlet 72 of reservoir 70 is not so that an interface is formed between the inlet and outlet which allows the excess oil to pass to the reservoir while also allowing a pressure venting action to occur. The threads allow for a path through which the pressure can be vented. Accordingly, oil is collected in the external reservoir and can be emptied while being serviced.

Figure 9:
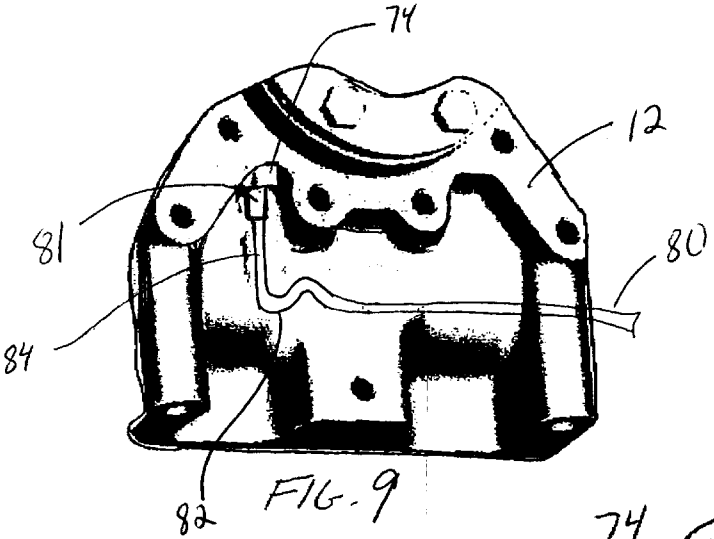
FIG. 9 is a view similar to FIG. 7, showing an alternative design using an overflow tube.

Alternatively, as shown in FIG. 9, in place of the external reservoir, a tube 80 is used as the receiver and is attached via connecting end 81 to housing 12 at outlet 74, through which oil can be directed for draining. As shown in FIG. 9, tube 80 includes a preformed segment 82, connected to vertically, downward extending tube-portion 84. Segment 82 is U-shaped, forming a trap which will fill with waste-compressor or excess oil being drained, and will prevent atmospheric moisture and debris from entering back into the compressor housing via the tube. While the invention has been described in reference to a preferred embodiment and a particular type of compressor, it is to be understood by those skilled in the art that modifications and variations can be effected within the spirit and scope of the invention and the invention could be applied to different types of compressors or other mechanisms incorporating similar type shaft seals.

What is claimed is:

1. A compressor oil diversion system for use in a compressor having a housing, a crankshaft having shaft seals, refrigerant and a compression device for compressing the refrigerant, the system comprising:

a shaft sealing mechanism using a lubricant for preventing compressor refrigerant from leaking out of the compressor housing;

a space within said shaft sealing mechanism where said lubricant collects;

a diversion mechanism for directing an excess amount of said lubricant from said space; and a receiver for receiving said excess amount of said lubricant from said diversion mechanism.

2. The system according to claim 1, further including an article for placement in said receiver for collecting said excess amount of said lubricant.

3. The system according to claim 2, wherein said article is a removable cartridge.

4. The system according to claim 3, wherein said article includes an absorbent material for absorbing said excess amount of said lubricant.

5. The system according to claim 4, wherein said article is a cartridge having an absorbent portion for absorbing said lubricant and a connecting portion for connecting to the housing.

6. The system according to claim 5, wherein said cartridge is elongated, and includes and elongated absorbent portion integral with said connecting portion.

7. The system according to claim 3, wherein said article is securable to the housing and in said receiver.

8. The system according to claim 3, wherein said removable cartridge includes an opening exposed to atmospheric pressure for facilitating a visual assessment of the saturation level of said cartridge.

9. The system according to claim 1, wherein said diversion mechanism comprises a passage in said housing leading to said receiver.

10. The system according to claim 1, wherein said shaft seal mechanism includes a mechanical shaft seal, first and second face seals, and a lip seal.

11. The system according to claim 10, wherein said space is located between said second face seal and said lip seal.

12. The system according to claim 11, wherein said diversion mechanism is a passage in said housing leading to said cavity, wherein said passage has an entrance located at said space.

13. The system according to claim 1, wherein said receiver is a reservoir located external to said housing.

14. The system according to claim 13, wherein said reservoir is attached to and removable from the housing and includes an inlet, and wherein the housing includes an outlet in communication with said diversion mechanism for connection to said inlet.

15. The system according to claim 14 wherein said inlet and said outlet have an interface allowing for pressure venting.

16. The system according to claim 1, wherein said receiver is a tube.

17. The system according to claim 16, wherein said housing includes an outlet in communication with said diversion mechanism, said tube including an inlet connectable to said outlet.

18. The system according to claim 17, wherein said tube includes a trap for catching debris.

* * * * *